US006186606B1

(12) United States Patent
Krei

(10) Patent No.: US 6,186,606 B1
(45) Date of Patent: Feb. 13, 2001

(54) LATERAL FILE LOCKING SYSTEM

(75) Inventor: Christopher J. Krei, Chicago, IL (US)

(73) Assignee: The Marvel Group, Inc., Chicago, IL (US)

( * ) Notice: Under 35 U.S.C. 154(b), the term of this patent shall be extended for 0 days.

(21) Appl. No.: 09/190,549

(22) Filed: Nov. 12, 1998

Related U.S. Application Data

(60) Provisional application No. 60/104,688, filed on Oct. 17, 1998.

(51) Int. Cl.[7] ..... E05C 7/06

(52) U.S. Cl. ..... 312/221; 312/222

(58) Field of Search ..... 312/221, 220, 312/222, 217

(56) References Cited

U.S. PATENT DOCUMENTS

| | | | | |
|---|---|---|---|---|
| 1,013,444 | | 1/1912 | Robbins . | |
| 1,740,672 | | 12/1929 | Vignos . | |
| 2,097,504 | | 11/1937 | Wells . | |
| 2,448,748 | | 9/1948 | Vanderveld . | |
| 2,750,901 | | 6/1956 | McClellan . | |
| 2,882,112 | | 4/1959 | Jarvi . | |
| 3,223,466 | | 12/1965 | Roberts . | |
| 3,649,095 | | 3/1972 | Gunzberg . | |
| 3,936,108 | * | 2/1976 | Chitester | 312/217 |
| 4,040,653 | * | 8/1977 | Takahashi | 312/222 X |
| 4,132,440 | | 1/1979 | Johnson . | |
| 4,239,309 | | 12/1980 | DeFouw et al. . | |
| 4,453,787 | * | 6/1984 | Staropoli | 312/222 X |
| 4,465,328 | | 8/1984 | Tihanyi et al. . | |
| 4,477,130 | | 10/1984 | Frantz . | |
| 4,525,012 | | 6/1985 | Dunner . | |
| 4,662,689 | | 5/1987 | Chatterson et al. . | |
| 4,820,002 | * | 4/1989 | Lechner et al. | 312/221 |
| 5,176,436 | * | 1/1993 | Mitchell | 312/221 |
| 5,199,774 | * | 4/1993 | Hedinger et al. | 312/221 X |
| 5,249,443 | | 10/1993 | Anderson . | |
| 5,292,191 | | 3/1994 | Slivon . | |
| 5,988,778 | * | 11/1999 | Lammens | 312/221 X |

FOREIGN PATENT DOCUMENTS

| | | | | |
|---|---|---|---|---|
| 1084096 | * | 8/1980 | (CA) | 312/221 |
| 1255213 | * | 1/1961 | (FR) | 312/221 |
| 1454844 | * | 8/1966 | (FR) | 312/222 |
| 2523631 | * | 9/1983 | (FR) | 312/221 |
| 25176 | * | of 1899 | (GB) | 312/217 |
| 1584777 | * | 2/1981 | (GB) | 312/222 |

* cited by examiner

*Primary Examiner*—Peter M. Cuomo
*Assistant Examiner*—David E. Allred
(74) *Attorney, Agent, or Firm*—Edgar A. Zarins; Lloyd D. Doigna

(57) ABSTRACT

A locking system for a file cabinet which prevents opening of more than one drawer of the cabinet. The locking system includes a camming system which blocks opening of any secondary drawers after a first drawer has been opened. A rotatable cam having a hook mounts to an individual lock lever. The hook engages an opening in the file drawer or door to prevent retraction while also blocking the interlocking mechanism for the file drawers.

9 Claims, 5 Drawing Sheets

LATERAL FILE LOCKING SYSTEM

This application claims the benefit and priority of U.S. Provisional Application No. 60/104,688 filed Oct. 17, 1998.

BACKGROUND OF THE INVENTION

I. Field of the Invention

This invention relates to a locking system for a file cabinet and, in particular, to a rotatable cam lock which engages the individual drawer and simultaneously blocks the interlocking mechanism of the file system.

II. Background of the Invention

File systems typically include a plurality of drawers or cabinet doors positioned in a vertical arrangement to maximize storage space. In the case of drawers, the individual drawers are slidably extractable from the cabinet to allow access to the interior contents of the drawer. A flip up door may be employed to enclose the individual storage units facilitating access from the front of the unit rather than the top as in a drawer. In order to maintain stability of the cabinet, it is preferred that only one drawer be allowed to be extracted at a time. Interlocking systems have long been employed which prevent multiple drawers from being opened in such cabinets. However, the prior known file systems employ interlocking systems which are separate from the overall locking assembly for the cabinet. The increased part requirements for such a separate locking system increases the costs and complexity of manufacturing of the cabinet.

SUMMARY OF THE PRESENT INVENTION

The present invention overcomes the disadvantages of the prior known file cabinets by providing a simple locking system which engages the individual file drawer or door while also blocking the interlocking mechanism of the cabinet to control opening of the drawers.

The file cabinet of the present invention incorporates a plurality of file drawers positioned vertically within the cabinet for individual extraction from the cabinet. The drawers ride on a slider assembly for simple movement into and out of the cabinet. The locking system is incorporated into the side wall of the cabinet for engagement with the individual drawers for locking the entire cabinet preventing extraction of any of the drawers. The lock assembly is a single cam lock which hooks into a front panel of the uppermost drawer and engages the interlocking mechanism of the cabinet thereby preventing the other drawers from being opened.

The locking assembly includes a key-operated spindle rotatable within the cabinet wall. Mounted to the rotatable spindle is a lever hook which is movable between an unlocked position and a locked position. The lever hook includes a hook and an end-plate. In the locked position the hook is inserted into an aperture of the front panel of the cabinet while the end plate engages the interlocking mechanism preventing extraction of the drawers. The interlocking mechanisms controls movement of the drawers when one of the drawers has been pulled out. As a result, a simple, single locking mechanism is used to control access to the contents of the file cabinet.

Other objects, features and advantages of the invention will be apparent from the detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
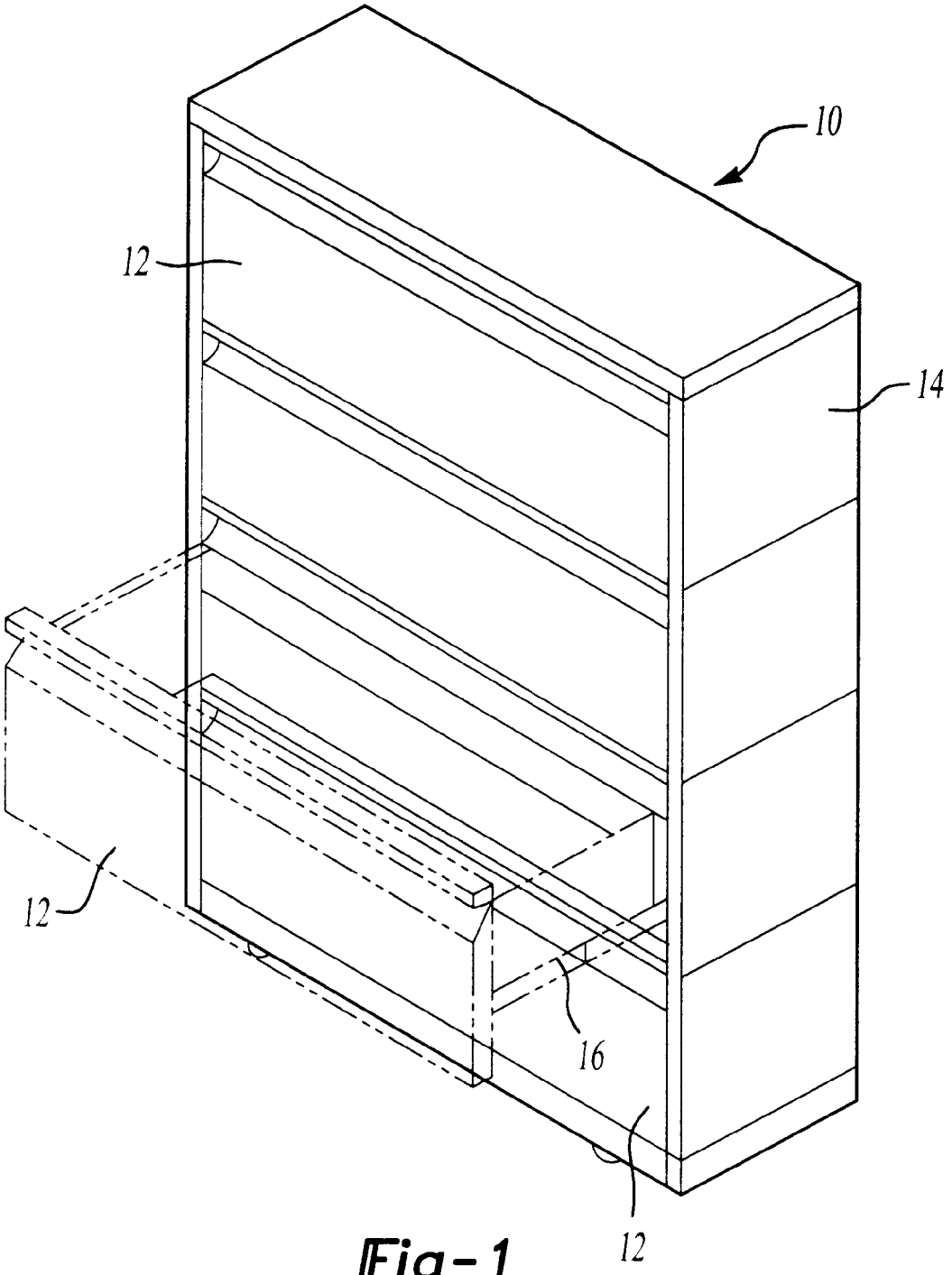
FIG. 1 is a perspective view of a file cabinet incorporating the locking system of the present invention.
Figure 2:
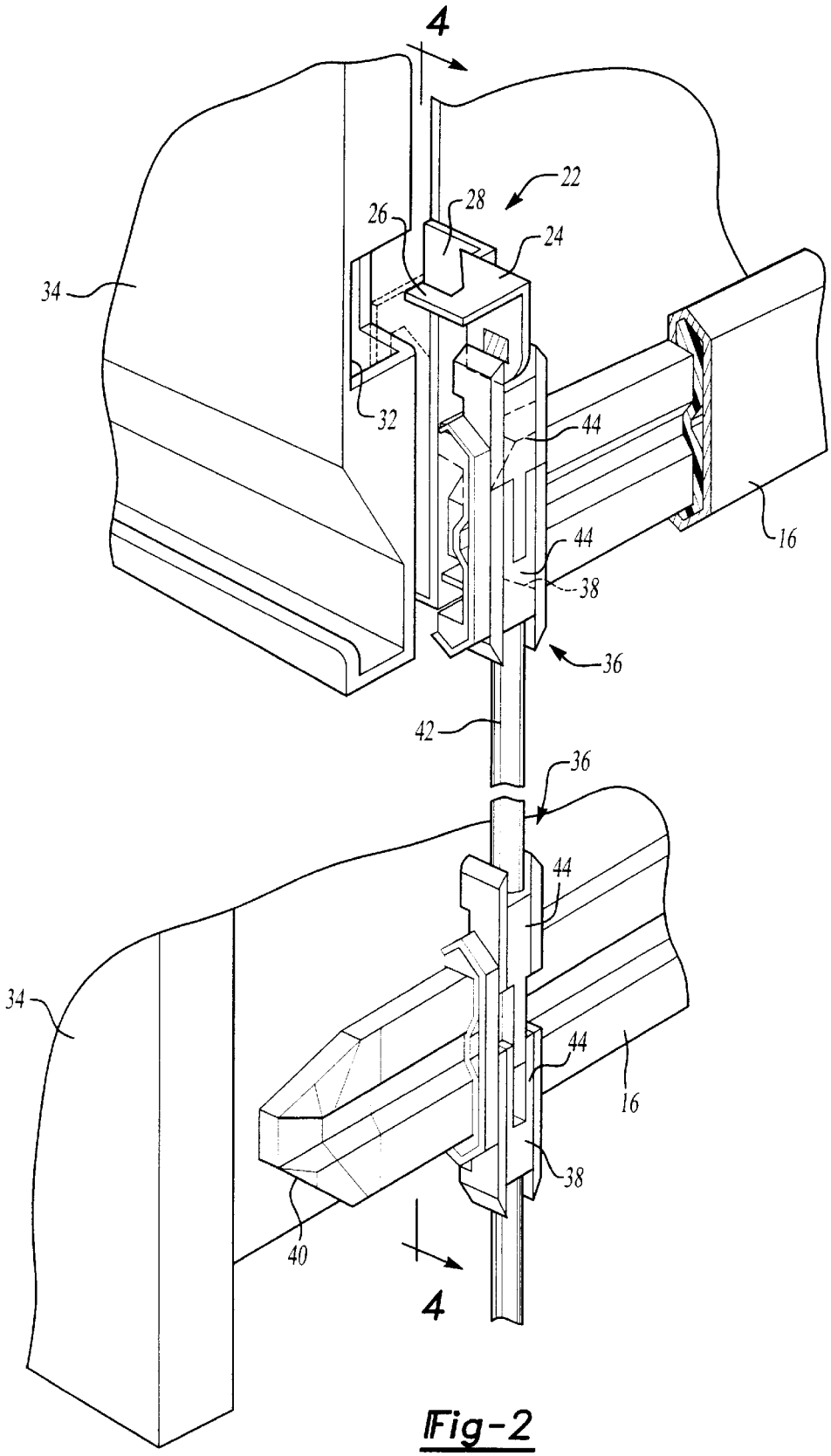
FIG. 2 is an enlarged perspective view of the locking system.
Figure 3:
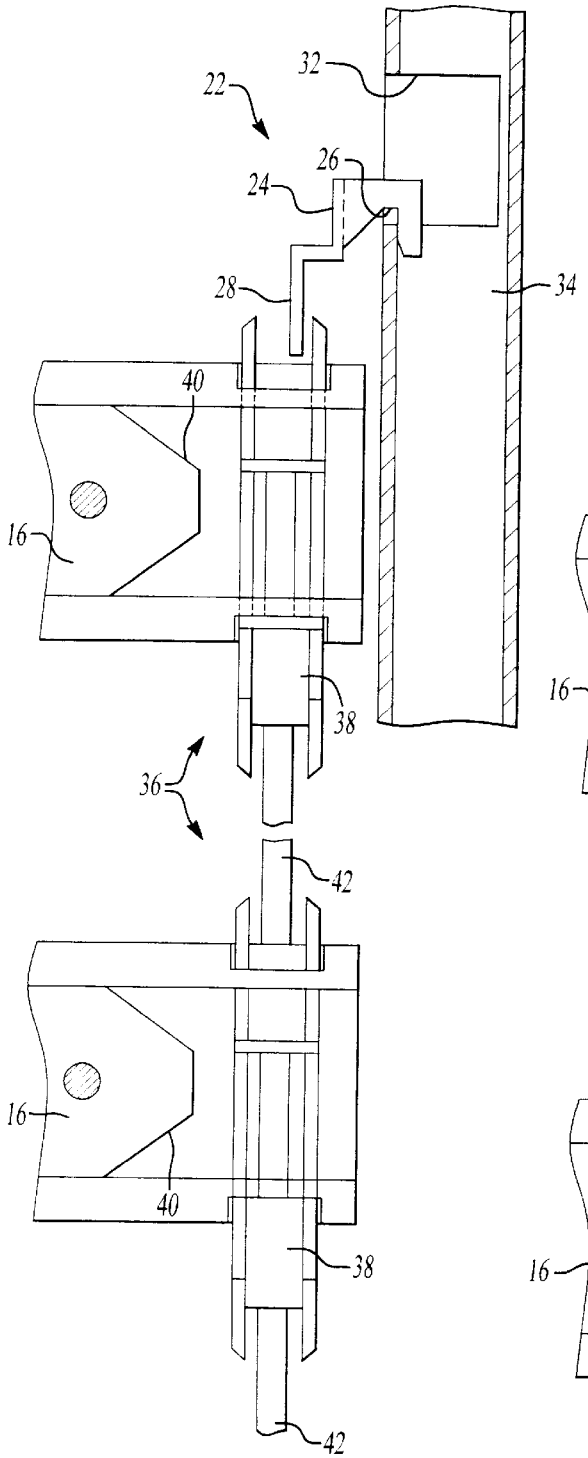
FIG. 3 is a side view of the locking system in a locked position.
Figure 4:
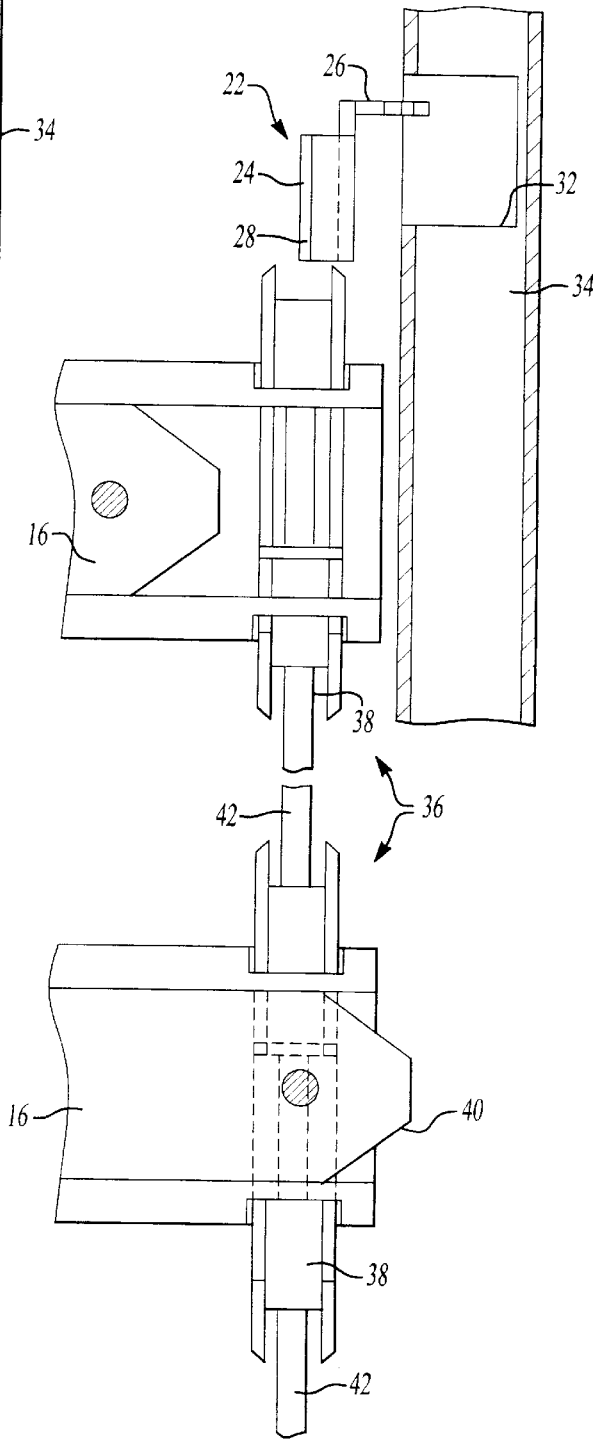
FIG. 4 is a side view of the locking system in an unlocked position.
Figure 5:
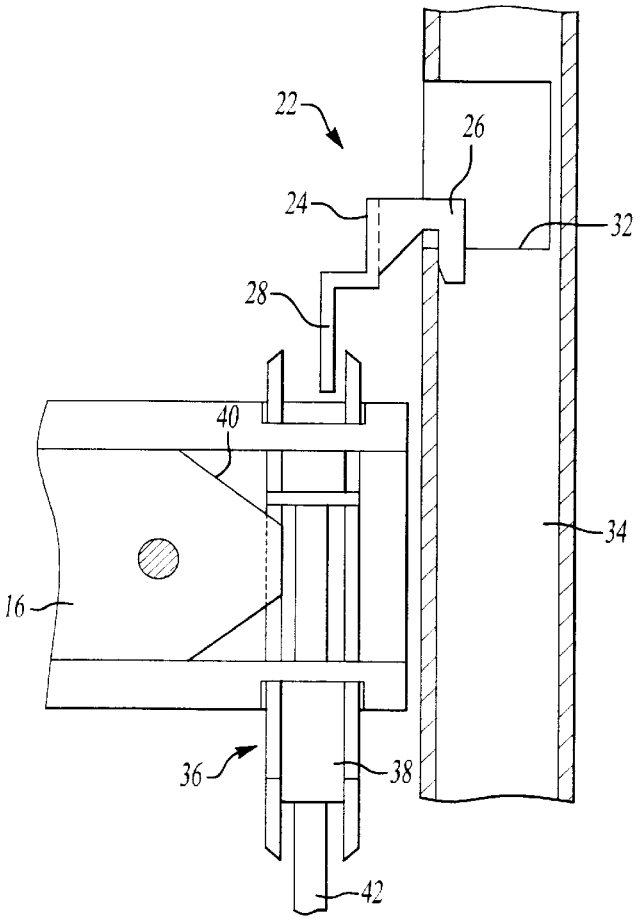
FIG. 5 is a partial view of the locking system in the locked position.
Figure 6:
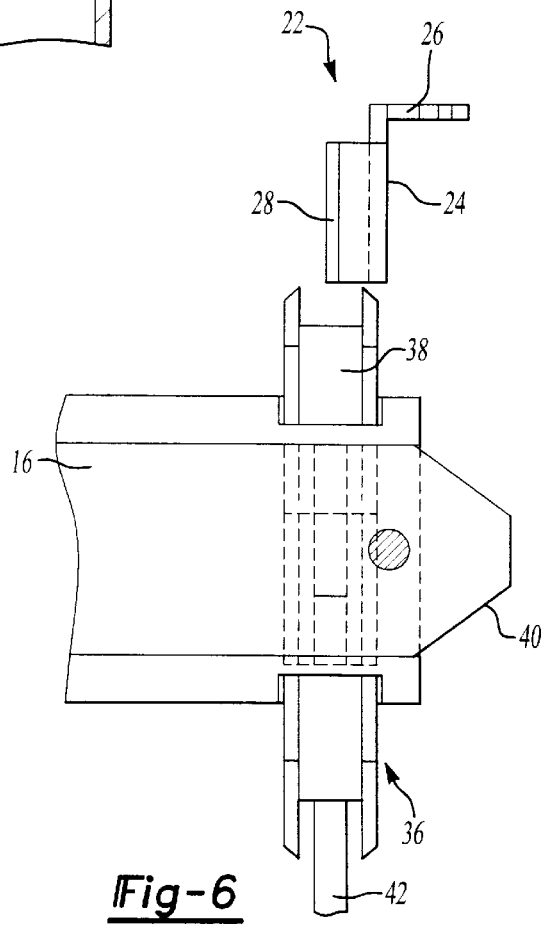
FIG. 6 is a partial view of the locking system in the unlocked position.
Figure 7:
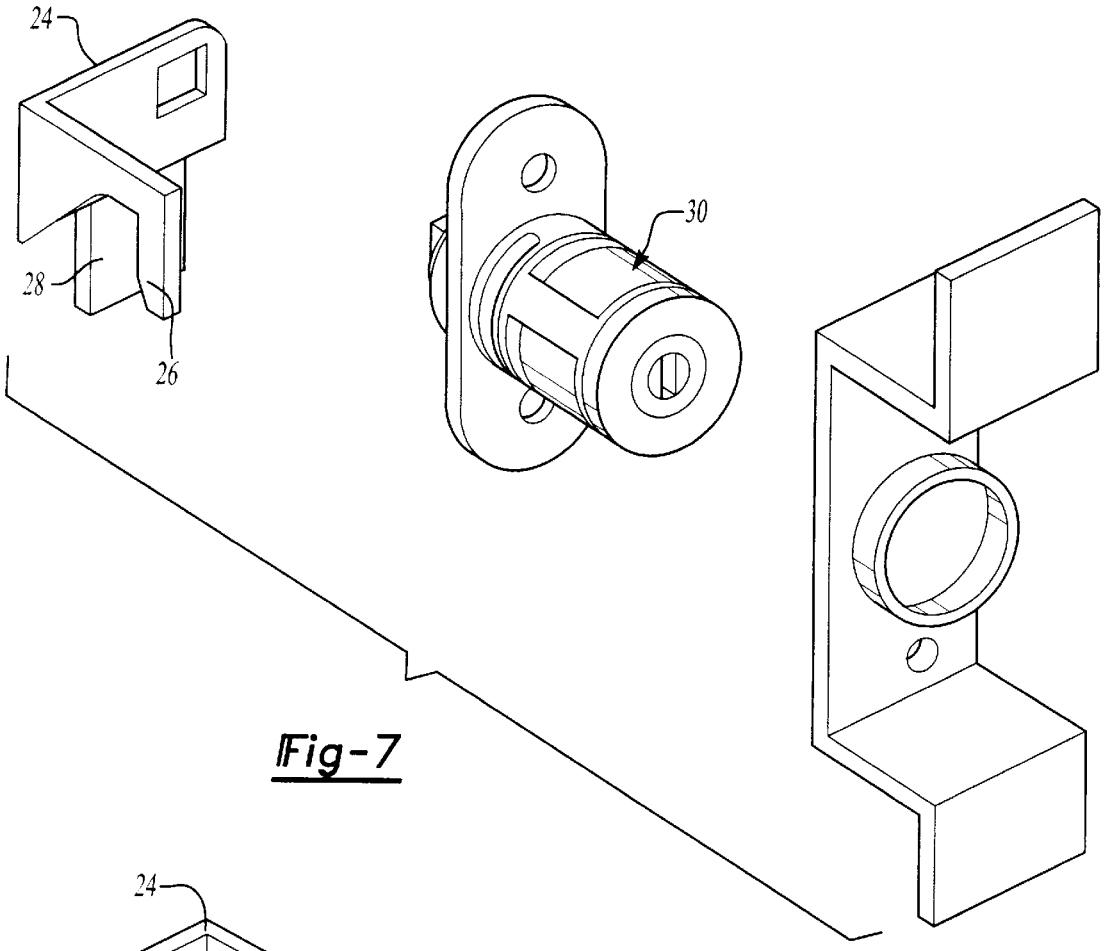
FIG. 7 is an exploded view of the locking system.
Figure 8A:
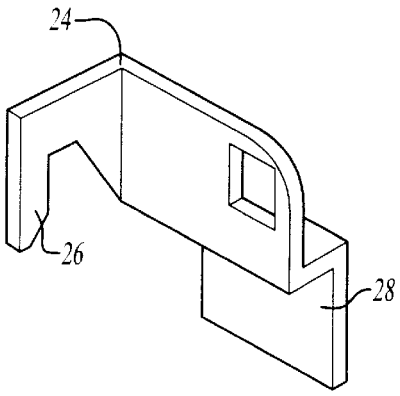
FIGS. 8A and 8B are perspective views of a locking cam of the locking system.
Figure 8B:
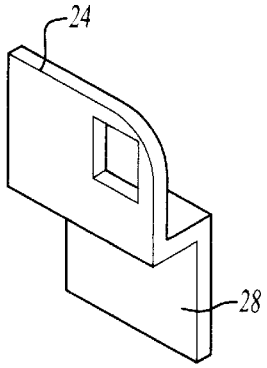

Referring first to FIGS. 1 and 2, there is shown two embodiments of a filing cabinet 10 incorporating a locking system embodied in the present invention. The filing cabinet 10 is a lateral file cabinet with a plurality of selectively extractable file drawers 12. The file drawers 12 are positioned in a vertical orientation and are independently selectively movable between a stored position within the cabinet housing 14 and an extended position exteriorly of the housing 14 for access to the contents of the drawer 12. In a well known manner, the individual drawers 12 are supported on a slider assembly 16 which facilitate lateral movement of the drawer 12 into and out of the cabinet housing 14. The embodiment of FIG. 2 includes four extractable file drawers 12 for storage of files and records. In place of the top drawer, the embodiment of FIG. 1 includes a flip door 18 to provide selective access to the interior storage area 20 at the top of the cabinet 10. Both embodiments of the file cabinet 10 incorporate locking systems to secure the drawers and flip door controlling access to the interior storage area 20 at the top of the cabinet 10.

Referring now to FIGS. 3 through 7, the locking system 22 of the present invention operates in conjunction with the interlocking mechanism of the cabinet 10 which prevents more than one drawer 12 from being opened. The locking system 22 is incorporated into the side wall of the cabinet 10 and operated by a key (not shown). The primary component of the locking system 22 is a rotatable cam 24. The cam 24 includes a hook member 26 and a flange 28. The cam 24 cooperates with a lock cylinder 30 for rotation under operation of a key. Rotation of the cam 24 in a first direction will cause the hook member 26 to engage an opening 32 in a front panel 34 of the flipper door 18 or drawer 12. Once inserted into the opening 32, the drawer 12 or door 18 is prevented from being opened. Simultaneously, the flange 28 of the rotatable cam 24 is rotated into engagement with the interlocking mechanism 36 of the cabinet 10 preventing opening of the other drawers 12 as will be subsequently described. As a result, a single simple locking system 22 operates in cooperation with the interlock 36 of the cabinet 10 to selectively lock all of the drawers of the cabinet 10.

The interlocking mechanism 36 of the file cabinet 10 operates to allow opening of only one drawer 12 at any time. Upon opening of one drawer 12, the interlocking mechanism 36 prevents the subsequent opening of additional drawers 12. The interlocking mechanism 36 cooperates with the sliders 16 of each of the drawers 12 and includes a clamp 38 adjacent each slider 16. The clamps 38 of the interlocking mechanism 36 are connected by a rod 42 such that the clamps 38 operate in unison. The slider 16 has a tapered forward end 40 which allows the clamp 38 to contract when the drawer 12 is pushed in the cabinet housing 14. As the slider 16 moves through the clamp 38 when the drawer 12 is pulled from the cabinet 10, the clamp 38 is expanded. The clamp halves 44 drive respective connecting rods 42 outwardly to hold the other clamps 38 in a contracted or closed position preventing the respective sliders 16 from moving through the clamps 38. Accordingly, only one drawer 12 may be opened in the file cabinet 10.

The lock assembly 22 operates in conjunction with the interlocking mechanism 36 to prevent withdrawal of the file drawers 12 when the assembly 22 is locked. Rotation of the cam 24 from the unlocked position to a lock position (FIGS. 4 and 6) causes the hook 26 to engage and retain the front panel 34. Additionally, the flange 28 rotates downwardly to engage the uppermost clamp 38 preventing expansion of the clamps 38 to receive the slider 16. With the clamps 38 maintained in a contracted position, none of the drawers 12 can be opened. Rotation of the cam 24 to an unlocked position (FIGS. 5 and 7) not only releases the front panel 34 but also releases the interlocking mechanism. As a result, one of the drawers 12 can be opened as necessary.

The foregoing detailed description has been given for clearness of understanding only and no unnecessary limitations should be understood therefrom as some modifications will be obvious to those skilled in the art without departing from the scope and spirit of the appended claims.

What is claimed is:

1. In a file cabinet having a plurality of drawers selectively movable between a closed position disposed within said cabinet and an open position slidably extended from within said cabinet to provide access to the contents of said drawers, said file cabinet including an interlocking mechanism cooperating with said drawers to prevent more than one of said drawers from being opened simultaneously, the improvement comprising:

a locking assembly having a rotatable locking cam movable between an unlocked position allowing opening of said drawers and operation of said interlocking mechanism and movement of said drawers to said open position, said rotatable locking cam including a hook member formed in a plane and movable upon rotation of said locking cam between an unlocked position and a locked position engaging a front panel of said file cabinet and wherein said locking cam includes a flange which selectively engages said interlocking mechanism upon rotation of said locking cam to said locked position.

2. The improvement as defined in claim 1 wherein said hook member is disposed in said plane substantially perpendicular to the plane of said flange on said locking cam.

3. The improvement as defined in claim 2 wherein said front panel of said file cabinet has an opening for selectively receiving said hook member, positioning of said hook member within said opening upon rotation of said locking cam to said locked position prevents opening of said front panel.

4. The improvement as defined in claim 1 wherein said flange of said locking cam engages a clamp member of said interlocking mechanism upon rotation of said locking cam to said locked position, said flange preventing said clamp member from expanding when in said locked position.

5. The improvement as defined in claim 1 wherein said locking cam is operated by key means inserted into said locking assembly facilitating rotation of said locking cam between said unlocked and locked positions.

6. In a file cabinet having a plurality of drawers selectively movable between a concealed position disposed within said cabinet and an open position slidably extended from within said cabinet to allow access to the contents of said drawers, said file cabinet including an interlocking mechanism extending between said drawers to prevent more than one of said drawers from being open simultaneously, the improvement comprising:

a locking assembly having a rotatable locking cam with a flange pivotably movable between an unlocked position allowing operation of said interlocking mechanism and opening of said drawers and a locked position engaging said interlocking mechanism preventing operation of said interlocking mechanism thereby preventing movement of said drawers to said open position, said rotatable locking cam including a hook member formed in a plane and movable upon rotation of said locking cam between an unlocked position and a locked position engaging a front panel of said file cabinet to prevent movement of said front panel.

7. The improvement as defined in claim 6 wherein said flange for selectively engaging said interlocking mechanism extends perpendicular to the axis of rotation of said locking cam.

8. The improvement as defined in claim 7 wherein said flange of said locking cam engages a clamp member of said interlocking mechanism to prevent expansion of said clamp member upon rotation of said locking cam to said locked position, said flange preventing said clamp member from expanding thereby preventing operation of said drawers.

9. The improvement as defined in claim 7 wherein said front panel of said file cabinet has an opening for selectively receiving said hook member whereby positioning of said hook member within said opening upon rotation of said locking cam to said locked position prevents opening of said front panel.

* * * * *